US006036244A

United States Patent [19]

Tyves et al.

[11] Patent Number: 6,036,244

[45] Date of Patent: Mar. 14, 2000

[54] VEHICLE DOOR HANDLE ASSEMBLY

[75] Inventors: Zinovy Tyves, Windsor, Canada; Joseph Frank Carnaghi, Macomb, Mich.; Mark Vickery, Tecumseh, Canada; Brian A. Barnes, Utica, Mich.; Gordon Leroy Cook, Flint, Mich.; Derek L. Roberts, Waterford, Mich.; Philippe Jenot, Windsor, Canada; Mike Skiba, Sterling Heights, Mich.

[73] Assignee: General Motors Corporation, Detroit, Mich.

[21] Appl. No.: 09/288,841

[22] Filed: Apr. 8, 1999

[51] Int. Cl.[7] ..... E05B 3/00

[52] U.S. Cl. ..... 292/336.3; 292/348; 292/DIG. 53

[58] Field of Search ..... 292/347, 348, 292/352, 356, 336.3, DIG. 31, DIG. 63, DIG. 64, DIG. 53; 16/112, 114 R, 123

[56] References Cited

U.S. PATENT DOCUMENTS

| | | | |
|---|---|---|---|
| 3,606,428 | 9/1971 | Erck | 292/336.3 |
| 3,655,230 | 4/1972 | Armstrong | 292/169 |
| 4,834,433 | 5/1989 | Keller | 292/336.3 |
| 4,838,590 | 6/1989 | Isomura | 292/336.3 |
| 4,889,373 | 12/1989 | Ward et al. | 292/336.3 |
| 4,993,763 | 2/1991 | Tanimoto et al. | 292/336.3 |
| 5,011,202 | 4/1991 | Kato et al. | 292/336.3 |
| 5,647,234 | 7/1997 | Foster | 70/256 |
| 5,681,068 | 10/1997 | Kleefeldt et al. | 292/336.3 |
| 5,895,081 | 4/1999 | Tanimoto | 292/348 |

*Primary Examiner*—Flemming Saether
*Assistant Examiner*—Gary Estremsky
*Attorney, Agent, or Firm*—Kathryn A. Marra

[57] ABSTRACT

A vehicle door handle assembly has a support that includes a concave shell having a pair of vertically spaced bosses with pivot holes for two concentric shafts. One shaft is operated by a handle in the shell and moves an operating lever behind the shell. The other shaft is operated by a lock knob in the shell and moves a second operating lever behind the shell.

5 Claims, 2 Drawing Sheets

VEHICLE DOOR HANDLE ASSEMBLY

This invention relates generally to a vehicle door handle and more particularly to a vehicle door handle assembly that includes a door handle and a lock knob for operating a vehicle door latch from inside the vehicle.

BACKGROUND OF THE INVENTION

U.S. Pat. No. 4,838,590 granted to Yukio Isomura Jun. 13, 1989 for an inside handle device for vehicles discloses several inside handle devices that comprises a bracket, a handle disposed inside the bracket, a lock knob disposed inside the handle, and a pivot pin or pins for rotatably pivoting the handle and the lock knob on side portions of the bracket. The brackets in these arrangements have large openings that receive moveable portions of the handle and the knob that extend through the bracket to operate door latch components behind the bracket. These large openings provide access for deleterious matter to pass into the interior of the door panel and diminish the efficient operation of components inside the vehicle door.

U.S. Pat. No. 4,993,763 granted to Tetsurou Tanimoto; Yukio Isomura and Noboru Kanou Feb. 19, 1991 and U.S. Pat. No. 5,011,202 granted to Yuichi Kato and Masazumi Miyagawa Apr. 30, 1991 disclose similar arrangements.

SUMMARY OF THE INVENTION

The object of this invention is to provide a vehicle door handle assembly that has a handle and a lock knob that are pivotally mounted on a support shell to operate door latch components behind the shell while avoiding large openings in the shell.

A feature of the vehicle door handle assembly of the invention is that the vehicle door handle assembly includes a support shell that does not require any openings except for two small pivot holes.

Another feature of the vehicle door handle assembly of the invention is that the vehicle door handle assembly includes a support shell and two concentric pivot pins that are the only moveable components that extend through the support shell.

Yet another feature of the vehicle door handle assembly of the invention is that the vehicle door handle assembly includes two concentric pivot pins for transferring movement from a handle and a lock knob on a front side of a shell to operate levers on a back side of the shell.

Still another feature of the vehicle door handle assembly of the invention is that the vehicle door handle assembly includes a hollow pivot pin for transferring motion from a front side of the shell to a rear side of the shell that is pivotally supported on a second pivot pin for transferring motion from the front side of the shell to the rear side of the shell whereby the vehicle handle assembly can operate both the latching and the locking functions of a door latch.

These and other objects, features and advantages of the invention will become apparent from the description below, which is given by way of example with reference to the accompanying drawings.

DESCRIPTION OF THE PREFERRED EMBODIMENT

Figure 1:
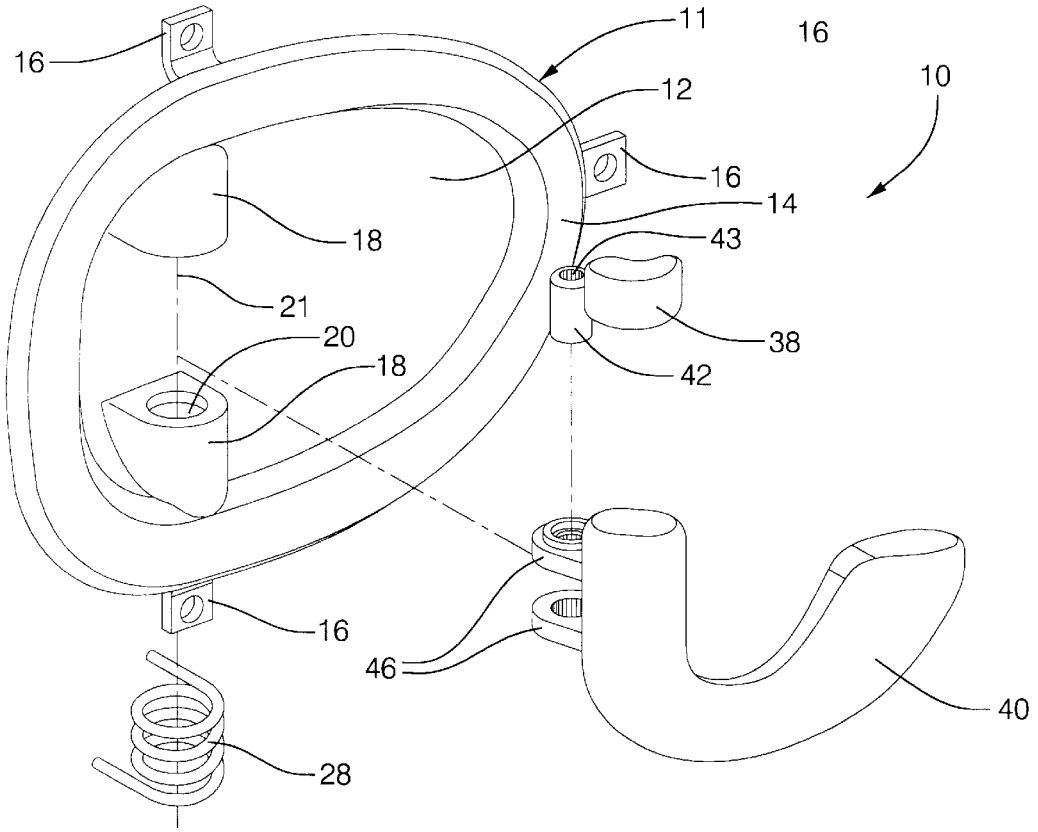
FIG. 1 is an exploded perspective front view of a vehicle door handle assembly in accordance with the invention.
Figure 2:
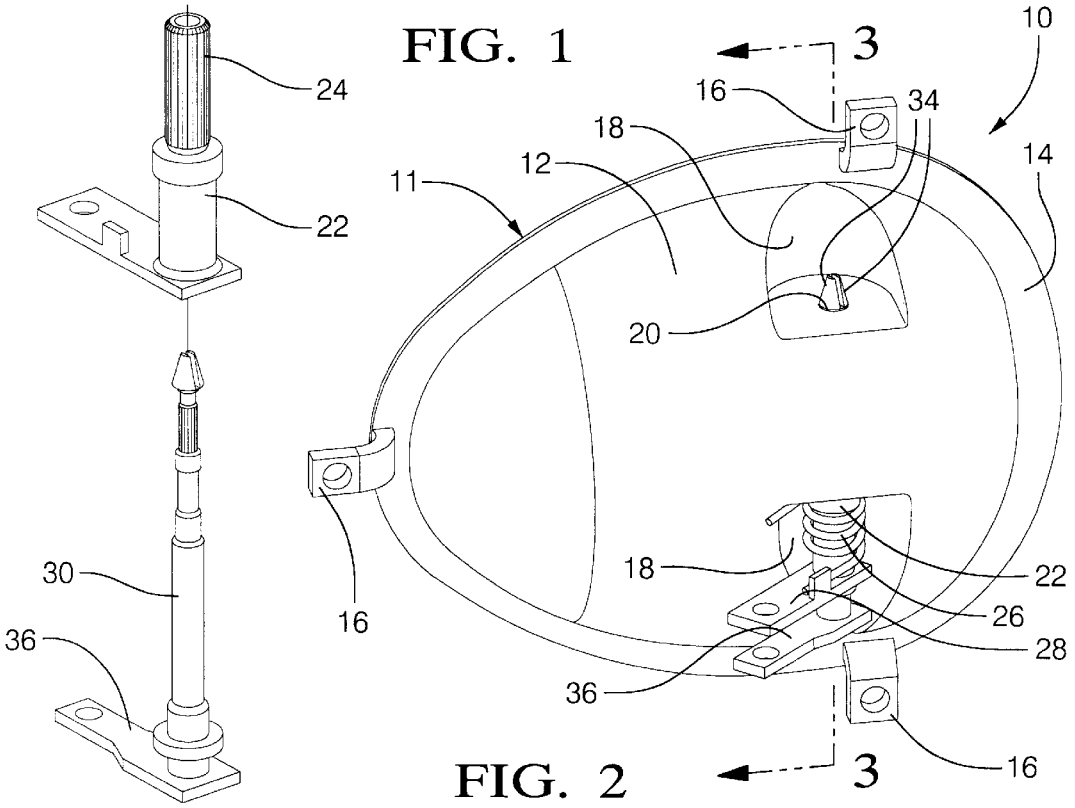
FIG. 2 is a rear view of the vehicle door handle assembly shown in FIG. 1.
Figure 3:
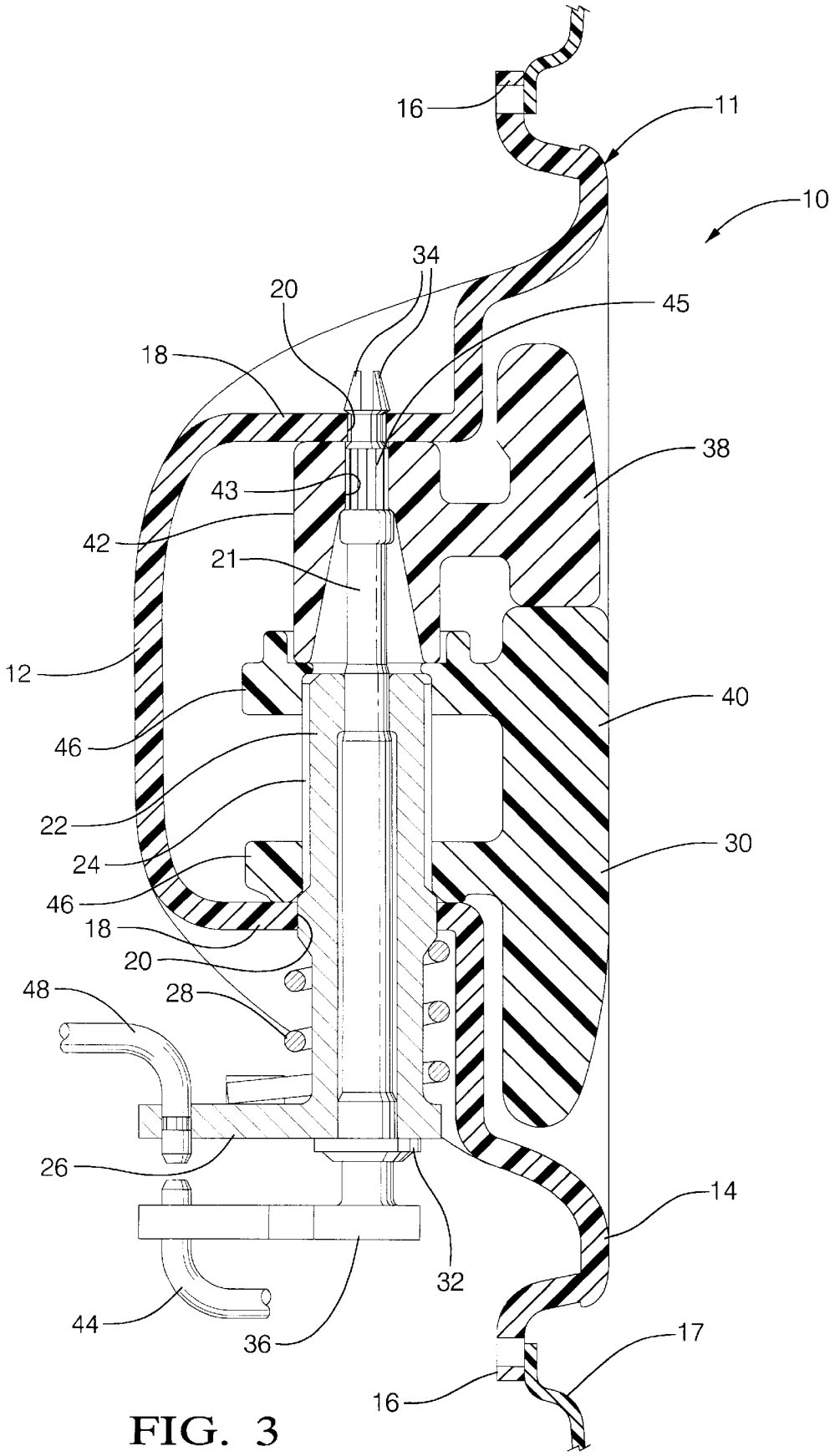
FIG. 3 is a section taken substantially along the line 3—3 of FIG. 2 looking in the direction of the arrows.

Referring now to FIGS. 1 and 2, a door handle assembly for 10 operating a vehicle door latch is indicated generally at 10. Door handle assembly comprises a support 11 in the form of a concave shell 12 having a peripheral flange 14 and three projecting attachment tabs 16 that are spaced around the peripheral flange 14. Tabs 16 are used to secure shell 12 to an inner trim panel 17 of a vehicle door as shown in FIG. 3.

Support 11 has a pair of vertically spaced bosses 18 formed out of the concave shell 12 near one end. Bosses 18 have aligned pivot holes 20 for establishing a pivot axis 21. Shell 12 is preferably imperforate except for the vertically aligned pivot holes 20 which are the only openings necessary for moving parts to extend through support 11.

Door handle assembly 10 includes a hollow shaft 22 that extends into the concave space of concave shell 12 through pivot hole 20 in lower boss 18 for rotation on pivot axis 21 with respect to shell 12. Shaft 22 has a splined upper portion 24 and a lever 26 at the lower end that is behind lower boss 18. A coil spring 28 surrounds the round lower end of shaft 22. Coil spring 28 engages the rear surface of lower boss 18 and a tab of lever 26 to bias shaft 22 in the counterclockwise direction.

A solid shaft 30 extends into the concave space of concave shell 12 through the hollow shaft 22 and out of the concave space through pivot hole 20 in upper boss 18 for rotation on pivot axis 21 with respect to concave shell 12 and with respect to hollow shaft 22. Shaft 30 has a lower collar 32 that engages the lower end of hollow shaft 22 for supporting hollow shaft 22 in the vertical direction. Shaft 30 has a bifurcated upper end with retention wings 34 that project outwardly. The bifurcated upper end is snapped through pivot hole 20 in upper boss 18 to hold shafts 22 and 30 in place with respect to support 11. Shaft 30 has a lever 36 at the lower end below collar 32.

Door handle assembly 10 includes a lock knob 38 and a handle 40 that are disposed in the hollow space of hollow shell 12 in respective rest positions. Lock knob 38 is non-rotatably attached to the upper portion of shaft 30 that projects out of the upper end of hollow shaft 22 by a collar 42 that projects rearwardly from the back of lock knob 38. Collar 42 has a splined hole 43 that receives a splined upper portion 45 of shaft 38. Lever 36 at the lower end of shaft 30 is operatively connected to a lock operating lever of the door latch (not shown) by a rod 44 or other suitable linkage so that knob 38 locks and unlocks the door latch (not shown). Conventionally the door latch is unlocked when knob 38 is pivoted from the rest position shown in FIG. 1 to an operating position rotated about 90 degrees clockwise from the position shown in FIG. 1. Automotive door latches are well known in the art and need not be described to understand the invention.

Handle 40 which is below lock knob 38, is non-rotatably attached to the splined upper portion 24 of hollow shaft 22 by two splined holed collars 46 that project rearwardly from handle 40 at one end. Lever 26 at the lower end of hollow shaft 22 is operatively connected to a latch operating lever of the door latch (not shown) by a rod 48 or other suitable linkage so that handle 40 unlatches the door latch (not shown). Conventionally the door latch is unlatched when handle 40 is pivoted clockwise against the bias of coil spring

28, from the rest position shown in FIG. 1 to an operating position rotated about 90 degrees clockwise from the position shown in FIG. 1. When handle 40 is released, handle 40 is returned to the rest position by coil spring 28. Door handle assembly 10 may include a return spring for lock knob 38. However, such a return spring may be omitted in many cases because the door latch itself usually has a return spring that returns lock knob 38 to the rest position via rod 44.

Lock knob 38 is preferably flush with the flange 14 of concave shell 12 when in the locked or rest position shown in FIG. 1. Handle 40 is also preferably flush with the flange 14 of concave shell 12 when in the latched or rest position shown in FIG. 1.

Many modifications and variations of the present invention in light of the above teachings may be made. It is, therefore, to be understood that, within the scope of the appended claims, the invention may be practiced otherwise than as specifically described.

We claim:

1. A vehicle door handle assembly for operating a vehicle door latch comprising:

a support including a concave shell having a pair of vertically spaced bosses formed therein near one end of the shell, the vertically spaced bosses having vertically aligned upper and lower pivot holes for establishing a pivot axis, a hollow shaft extending into a concave space of the concave shell through one of the pivot holes, a second shaft extending into the concave space of the concave shell through the hollow shaft and out of the concave space through another of the pivot holes, a handle disposed in the concave space of the concave shell and attached to one of the first hollow shaft and the second shaft for rotation therewith, a lock knob disposed in the concave space of the concave shell and attached to another of the first hollow shaft and the second shaft for rotation therewith, a first lever attached to the first hollow shaft outside of the concave space, and a second lever attached to the second shaft outside of the concave space.

2. The vehicle door handle assembly as defined in claim 1 wherein the vertically aligned pivot holes are the only openings in the shell having moving parts extending through the shell.

3. The vehicle door handle assembly as defined in claim 1 further including a return spring operatively connected to one of the first hollow shaft and the second shaft.

4. A vehicle door handle assembly for operating a vehicle door latch comprising:

a support including a concave shell having a peripheral flange for engaging a door panel and a pair of vertically spaced bosses formed in the concave shell near one end, the bosses having vertically aligned upper and lower pivot holes that establish a pivot axis and that are the only openings in the shell for moving parts to extend through the shell, a hollow shaft extending into the concave shell through the lower pivot hole for rotation with respect to the shell near one end, a solid shaft extending into the shell through the hollow shaft and out of the shell through the upper pivot hole for rotation with respect to the shell and with respect to the hollow shaft, a handle disposed in the shell and attached to the hollow shaft for rotation with the hollow shaft between a latched position where the handle is flush with the flange of the shell and an unlatched position where the handle extends outwardly of the shell, a lock knob disposed inside the shell and attached to the solid shaft for rotation with the solid shaft between a locked position where the lock knob is flush with the flange of the shell and an unlocked position where the lock knob extends outwardly of the shell, a first lever attached to a portion of the hollow shaft that is located outside of the shell, a torsion spring surrounding the portion of the first hollow shaft that is located outside of the shell, the torsion spring having one end engaging the shell and another end engaging the first lever for biasing the handle to the latched position, and a second lever attached to a portion of the second shaft that is located outside of the shell and below the hollow shaft.

5. The vehicle door latch assembly as defined in claim 4 wherein the shell is imperforate except for the upper and lower pivot holes.

* * * * *